US010638827B1

(12) United States Patent
Schlofman et al.

(10) Patent No.: US 10,638,827 B1
(45) Date of Patent: May 5, 2020

(54) MODULAR HIP BELT WITH GROSS AND FINE ADJUSTMENT

(71) Applicant: Pressio LLC, Peoria, AZ (US)

(72) Inventors: W. Scott Schlofman, Peoria, AZ (US); Michael L. Williams, Herriman, UT (US); Jeffrey Regan, Carlsbad, CA (US)

(73) Assignee: Pressio LLC, Peoria, AZ (US)

( * ) Notice: Subject to any disclaimer, the term of this patent is extended or adjusted under 35 U.S.C. 154(b) by 0 days.

(21) Appl. No.: 16/579,277

(22) Filed: Sep. 23, 2019

Related U.S. Application Data

(63) Continuation of application No. 16/286,409, filed on Feb. 26, 2019, now Pat. No. 10,420,412.

(51) Int. Cl.
*A45F 3/04* (2006.01)
*A45F 3/12* (2006.01)
*A47D 13/02* (2006.01)

(52) U.S. Cl.
CPC ..... *A45F 3/047* (2013.01); *A45F 3/12* (2013.01); *A47D 13/02* (2013.01); *A45F 2003/045* (2013.01); *A45F 2003/127* (2013.01)

(58) Field of Classification Search
CPC ..... A61F 5/028; A61F 5/03; A61F 2250/001; Y10T 24/342
See application file for complete search history.

(56) References Cited

U.S. PATENT DOCUMENTS 4,508,110 A * 4/1985 Modglin ..... A61F 5/022 2/44
5,346,461 A * 9/1994 Heinz ..... A61F 5/028 128/121.1
5,433,697 A * 7/1995 Cox ..... A61F 5/028 128/115.1
6,099,490 A * 8/2000 Turtzo ..... A61F 5/028 2/311
6,199,732 B1 * 3/2001 Swetish ..... A45F 3/04 224/262
6,213,968 B1 * 4/2001 Heinz ..... A61F 5/028 602/19
6,322,529 B1 * 11/2001 Chung ..... A61F 5/028 2/319
6,517,502 B2 * 2/2003 Heyman ..... A61F 5/03 128/876
6,602,214 B2 * 8/2003 Heinz ..... A61F 5/03 128/99.1
6,609,642 B2 * 8/2003 Heinz ..... A45F 3/00 224/628

(Continued)

*Primary Examiner* — Brian D Nash
(74) *Attorney, Agent, or Firm* — Thomas W. Galvani, P.C.; Thomas W. Galvani

(57) ABSTRACT

A hip belt includes a center panel, and first and second padded portions connected to the center panel and extending therefrom. Each of the first and second padded portions includes a rear end, an opposed front end, and a face extending therebetween. A pulley assembly is carried on the padded portion, and the pulley assembly includes proximal pulleys located at the rear end, distal pulleys located between the front and rear ends, and a cord wound therebetween. A collapsible panel between the proximal and distal pulleys collapses when the pulley assembly contracts. A buckle is carried at a front end of the respective first of second padded portion.

20 Claims, 9 Drawing Sheets

(56) References Cited

U.S. PATENT DOCUMENTS 6,676,620 B2 * 1/2004 Schwenn ..... A61F 5/0193 128/96.1
7,473,235 B2 * 1/2009 Schwenn ..... A61F 5/0193 128/100.1
7,727,172 B2 * 6/2010 Wang ..... A61F 5/028 602/19
8,142,377 B2 * 3/2012 Garth ..... A61F 5/028 602/19
8,172,779 B2 * 5/2012 Ingimundarson ..... A61F 5/028 602/19
8,328,742 B2 * 12/2012 Bledsoe ..... A61F 5/028 128/846
8,372,023 B2 * 2/2013 Garth ..... A61F 5/028 602/19
8,409,122 B2 * 4/2013 Cropper ..... A61F 5/024 128/876
10,092,440 B2 * 10/2018 White ..... A61F 5/02
2001/0034498 A1 * 10/2001 Heyman ..... A61F 5/03 602/19
2002/0148461 A1 * 10/2002 Heinz ..... A61F 5/03 128/96.1
2003/0034372 A1 * 2/2003 Thompson ..... A45F 3/047 224/637
2005/0192159 A1 * 9/2005 Jackson ..... A45F 3/14 482/23
2009/0118655 A1 * 5/2009 Wang ..... A61F 5/028 602/19
2010/0168630 A1 * 7/2010 Cropper ..... A61F 5/024 602/19
2011/0152737 A1 * 6/2011 Burke ..... A61F 5/026 602/19
2011/0213284 A1 * 9/2011 Garth ..... A61F 5/028 602/19
2012/0253251 A1 * 10/2012 Thornton ..... A61F 5/028 602/19
2013/0237891 A1 * 9/2013 Fryman ..... A61F 5/02 602/19
2013/0289461 A1 * 10/2013 Cropper ..... A61F 5/028 602/19
2014/0058306 A1 * 2/2014 Bannister ..... A61F 5/02 602/19
2014/0303536 A1 * 10/2014 Guldalian ..... A61F 5/028 602/19
2014/0364786 A1 * 12/2014 Haider ..... A61F 5/028 602/19
2014/0378880 A1 * 12/2014 Arsenault ..... A61F 5/028 602/14
2017/0065067 A1 * 3/2017 Carver ..... A45F 5/021
2017/0266030 A1 * 9/2017 Hess ..... A61F 5/0193
2018/0028343 A1 * 2/2018 McGee ..... A61F 5/028
2018/0353314 A1 * 12/2018 Grim ..... A61F 5/028

* cited by examiner

MODULAR HIP BELT WITH GROSS AND FINE ADJUSTMENT

CROSS-REFERENCE TO RELATED APPLICATIONS

This application is a continuation of and claims the benefit of prior U.S. patent application Ser. No. 16/286,409, filed Feb. 26, 2019, which is hereby incorporated by reference.

FIELD OF THE INVENTION

The present invention relates generally to support apparatus, and more particularly to hip belts for use with backpacks, child carriers, and the like.

BACKGROUND OF THE INVENTION

Hiking backpacks and baby- and child-carrier backpacks typically have shoulder straps and hip belts for supporting the weight of the pack contents. The shoulder straps carry much of the weight and provide lateral and sagittal support. The hip belt, however, is intended to support most of the weight of the pack. Hip belts are meant to be used such that the weight of the pack does not rest on the spine but rather on the pelvis, thereby transferring weight through the hips and legs, which are relatively more stable and supportive then the spine.

Hip belts often are not used, however. Some people forego their use entirely, allowing the full weight of a camping weekend to rest on their back. Others might loosely secure the hip belt around their waist to prevent the pack from tilting and moving around on their shoulders. Some may over-tighten, squeezing their belts or midsections. The misuse of the hip belt is a result of both miseducation and poor design. Most people are not aware of how to properly fit a hip belt. The belt should sit at the top of your hips, snugly hugging the iliac crest, so that the weight is comfortably carried by the pelvis.

This education issue is compounded by generally poor design in hip belts. Most belts employ a conventional buckle-based tightening system: two straps extend around two padded portions and are then coupled to each other with complemental buckles. The straps are tightened with a gross adjustment mechanism when the user pulls on free ends of the strap. The user can loosen the belt by lifting the buckles or pulling the strap the other way.

This design tends to force users to make only gross adjustments. Because the strap becomes more difficult to pull as the belt grows tighter, the user must apply more force on the strap, increasing the likelihood that when the strap actually does move, it will move significantly. It can thus be difficult to finely adjust a belt to the proper fit. An improved mechanism for adjusting not just backpack belts, but child-carrying pack belts and other types of belts, is needed.

SUMMARY OF THE INVENTION

A hip belt includes an inelastic center panel and first and second padded portions connected to the center panel and extending therefrom. Each of the first and second padded portions has a rear end proximate to the center panel, an opposed front end, and a face extending therebetween. Each also has an adjustable pulley assembly carried on the padded portion, and a strap secured to the pulley assembly over the padded portion for sliding movement along the face of the padded portion. A buckle is carried at the front end of each padded portion.

The above provides the reader with a very brief summary of some embodiments described below. Simplifications and omissions are made, and the summary is not intended to limit or define in any way the scope of the invention or key aspects thereof. Rather, this brief summary merely introduces the reader to some aspects of some embodiments in preparation for the detailed description that follows.

BRIEF DESCRIPTION OF THE DRAWINGS

Referring to the drawings.

DETAILED DESCRIPTION

Figure 1:
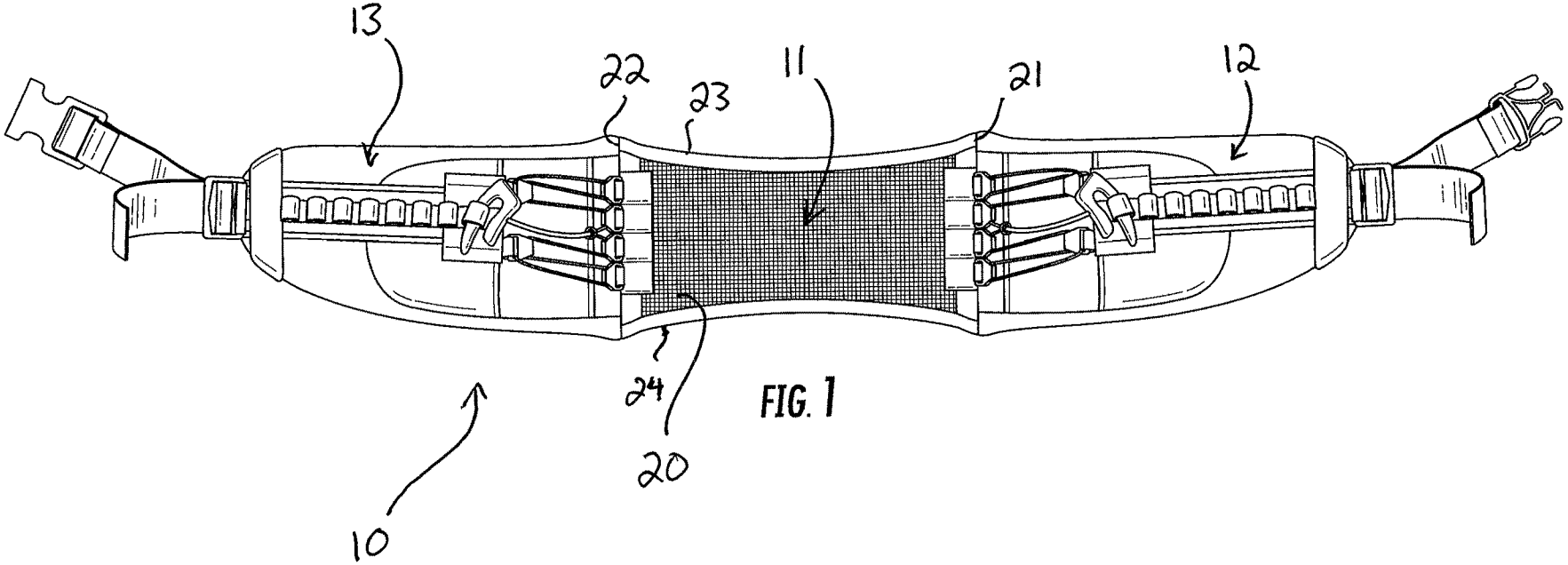
FIG. 1 is an elevation view of a modular hip belt with gross and fine adjustments, showing both left and right sides or padded portions of the hip belt.

Reference now is made to the drawings, in which the same reference characters are used throughout the different figures to designate the same elements. FIG. 1 illustrates a modular hip belt with boss gross and fine adjustment mechanisms (hereinafter, "hip belt 10"). The hip belt 10 includes a center panel 11 and first and second padded portions 12 and 13 connected to the center panel 11 and extending therefrom. For convenience and clarity, the first and second padded portions 12 and 13 will generally be referred to hereinafter as "right" and "left" padded portions 12 and 13 to correspond not only with their layout in the drawings but also with their intended orientation when the hip belt 10 is worn by a user.

The center panel 11 is preferably a flexible yet inelastic support between the right and left padded portions 12 and 13. It provides a base supporting the padded portions 12 and 13 and allows the hip belt 10 to, through a variety of means, be attached onto or integrated into a hiking backpack, child-carrying backpack, or other back support apparatus. The center panel 11 has an inner face, an outer face 20, opposed right and left sides 21 and 22, and a top 23 and bottom 24. The top 23 and bottom 24 are curved inwardly. The center panel 11 is constructed from a mesh panel and is reinforced at the sides 21 and 22 and at the top and bottom 24 with nylon hemming or webbing. This reinforcement assists in preventing the center panel 11 from stretching elastically.

The right and left padded portions 12 and 13 are affixed to the right and left sides 21 and 22 of the center panel 11, respectively. The right and left padded portions 12 and 13 are mirror identical, and so the following description of the right padded portion 12 applies equally to the left padded portion 13. As such, there will not be a detailed description of the left padded portion 13; one having ordinary skill in the art will readily understand how the description of the right padded portion 12 applies to the left padded portion 13. Further, the reference characters used to identify the various structural elements and features of the right padded portion 12 may also used to identify the same structural elements and features of the left padded portion 13. However, those of the left padded portion 13 may be marked with a prime ("") symbol so as to distinguish them from those of the right padded portion 12.

Figure 2:
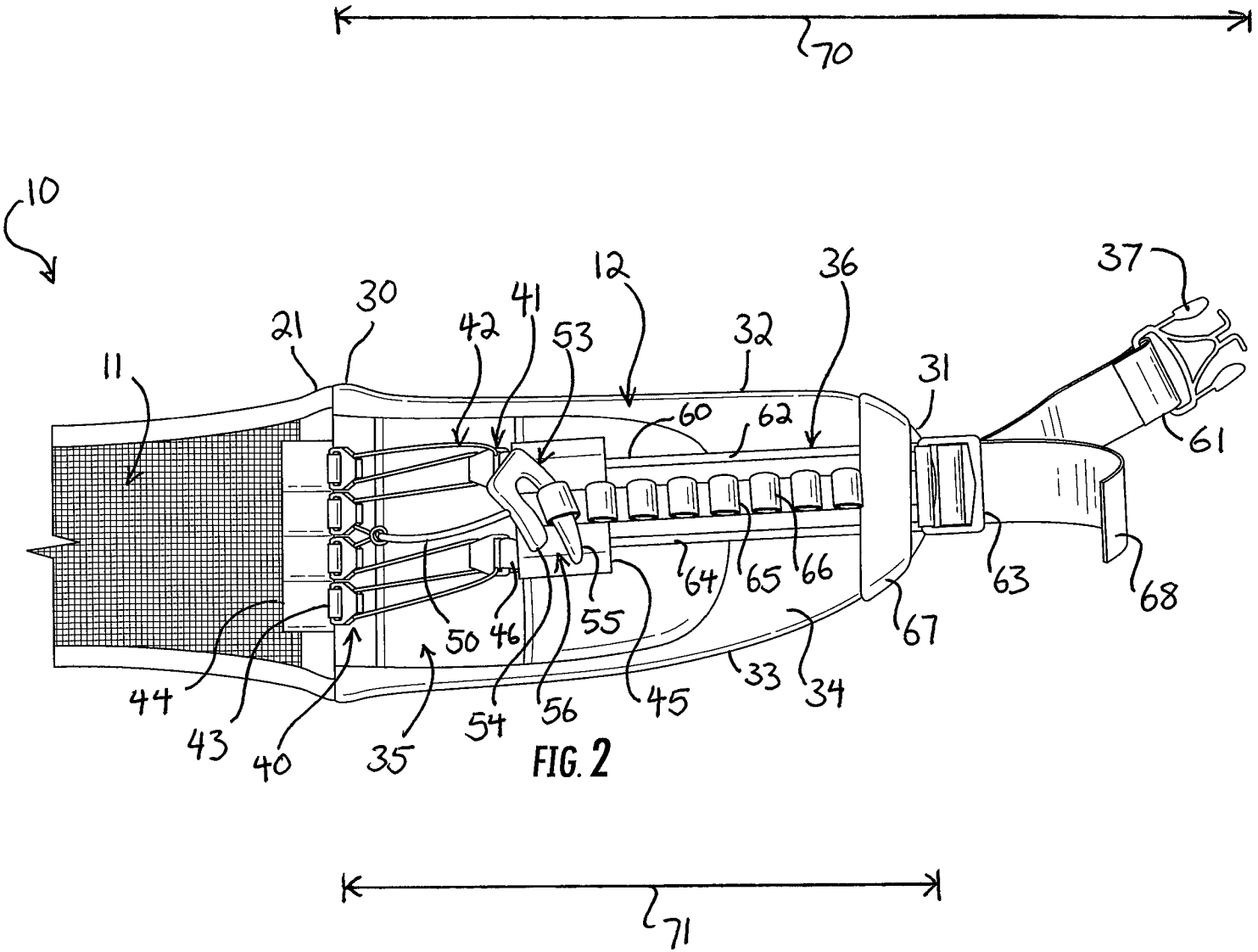
FIGS. 2 and 3 are elevation views of the right side of the hip belt of FIG. 1, showing loosened and tightened conditions, respectively.
Figure 3:
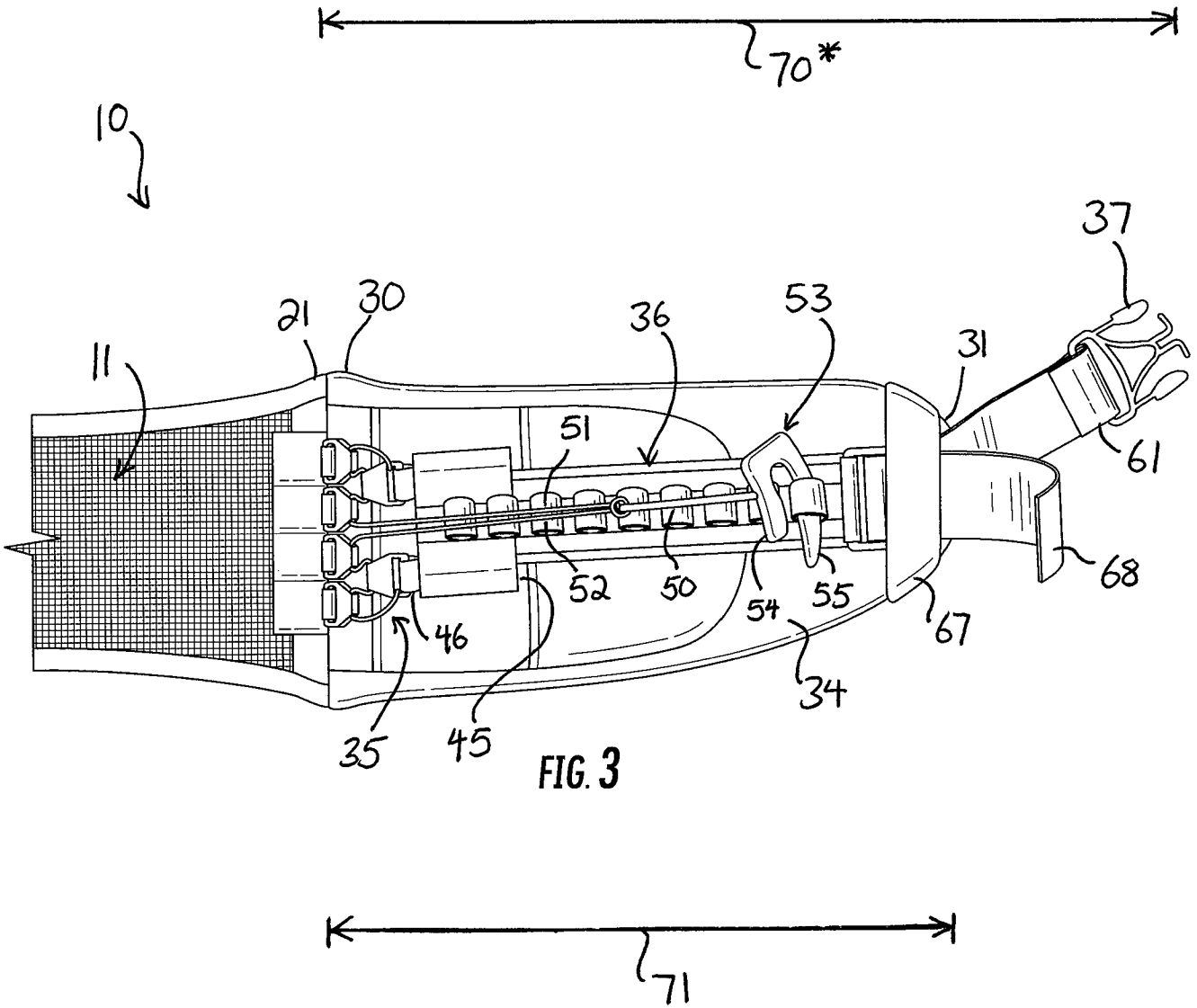

FIGS. 2 and 3 illustrate the right padded portion 12 in detail and show it in a first, loosened condition (FIG. 2) and a second, tightened condition (FIG. 3). The right padded portion 12 is a somewhat rigid and inflexible padded belt portion for placement over a user's hips when carrying a load. The right padded portion 12 is preferably constructed with a somewhat rigid plastic, metal, carbon fiber, or like insert, and a padded underlayer that is directed inward toward the user. The right padded portion 12 has a rear end 30 and an opposed front end 31. The rear end 30 is proximate to and fixed, such as by stitching, sonic welding, or other method, to the right side 21 of the center panel 11; when the hip belt 10 is worn, the rear end 30 is proximate the user's back and the front end 31 is proximate the user's front. The right padded portion 12 additionally has a top 32, a bottom 33, and an outer face 34 extending across the right padded portion 12 entirely between the top 32 and bottom 33 and between the rear and front ends 30 and 31. Across the outer face 34, the right padded portion further carries an adjustable pulley assembly 35 and a strap 36 to which a buckle 37 is attached.

The pulley assembly 35 includes a plurality of base or proximal pulleys 40, another plurality of distal pulleys 41, and a cord 42 threaded between the pulleys 40 and 41. The proximal pulleys 40 are secured to the outer face 34 of the right padded portion 12 at the rear end 30 thereof. Each of the proximal pulleys 40 has a short webbing lead 43 extending laterally (along the length of the right padded portion 12) toward the center panel 11. Each of the proximal pulleys 40 is arranged proximate the other in a stacked fashion, so that the webbing leads 43 all extend laterally in a parallel fashion, one above the other. The webbing leads 43 are then affixed to the outer face 34 with a length of webbing 43 sewn down onto the reinforced right side 21 of the center panel 11 across each of the webbing leads 43, closely to the proximal pulleys 40. This holds the webbing leads 43 in place, and also restricts any slack in the webbing leads 43 so that the proximal pulleys 40 maintain the lateral orientation toward the front end 31, as shown in FIGS. 2 and 3.

The distal pulleys 41 are fixed to a yoke panel 45. The yoke panel 45 is a piece of inelastic material, thin and small in size, having opposed sides. The distal pulleys 41 are secured to one side and the strap 36 is secured to the opposed side. The distal pulleys 41 also have webbing leads 46 which extend laterally. Unlike the webbing leads 43, these webbing leads 46 are secured directly to the yoke panel 45 by strong and rugged reinforced stitching. The distal pulleys 41 are oriented laterally toward the proximal pulley 40 such that they are in a confronting arrangement. Preferably, there are half as many distal pulleys 41 as proximal pulleys 40; in other embodiments, however, different pulley ratios may be advantageous. For example, it may be more preferable to have a 4:3 ratio of proximal pulleys 40 to distal pulleys 41, or the inverse. Other embodiments may have different vastly different ratios, as desired and needed for the intended use of the hip belt 10. In the embodiments shown throughout these drawings, there are two distal pulleys 41; an upper distal pulley 41 and a lower distal pulley 41. Likewise, there are two upper proximal pulleys 40 and two lower proximal pulleys 40. The upper distal pulley 41 corresponds to the two upper proximal pulleys 40, and the lower distal pulley 41 corresponds to the two lower proximal pulleys 40.

The winding of the cord 42 through the pulley assembly 35 reflects this two-to-one correspondence. The cord 42 includes a major pull cord 50 and two minor pulley cords 51 and 52. The major pull cord 50 is connected to the two minor pulley cords 51 and 52, extending from them, proximate the proximal pulleys 40, to a catch 53. The minor pulley cord 51 wraps through the lower of the upper proximal pulleys 40, around through the upper distal pulley 41, back to the upper of the upper proximal pulleys 40, and then back to the upper distal pulley 41, where it is anchored. Similarly, the minor pulley cord 52 wraps through the upper of the lower proximal pulleys 40, around through the lower distal pulley 41, back to the lower of the lower proximal pulleys 40, and the back to the lower distal pulley 41, where it is anchored.

The catch 53 on the cord 42 has two projecting jaws and 55, defining a space 56 therebetween. The cord 42 is attached to the jaw 54, which is short and blunt. Apart from the jaw 54, the jaw 55 is longer and sharp. The jaw 55 curves slightly back toward the jaw 54. The jaw 54 is useful to be grasped by a user and the jaw 55 is useful for engaging and securing the catch 53 along the right padded portion 12.

As described above, the strap 36 is fixed to a side of the yoke panel 45 opposite the distal pulleys 41. The strap 36 has a rear end 60 and an opposed front end 61. The terms rear end and front end are specific to the way the strap 36 is arranged on the right padded portion 12 and are distinct from opposed free ends of the strap 36. Indeed, the strap 36 has a first free end which is fitted with the buckle 37 at the front end 61, but also has another free end which is clearly visible in FIG. 2 near the front end 61 (hereinafter identified with the reference character 68). This is because the strap 36 is doubled or folded over itself, so that both free ends are located near the front end 61. However, as the strap 36 is arranged, the rear end 60 of the strap 36 is secured to the yoke panel 45 by strong and rugged reinforced stitching. The strap 36 has an inner face (not shown) and an outer face 62. The inner face is directed against the outer face 34 of the right padded portion 12, and the outer face 62 is directed away from it. The outer face 62, between the yoke panel 45 and an adjuster buckle 63, carries a second webbing layer 64, and on top of that, a strip of molle 65. The strip of molle 65 is a strip of spaced-apart nylon loops 66. The loops 66 are arranged normal to the length of the right padded portion 12, so that their openings are directed vertically up and down.

At the front end 31 of the right padded portion 12, a band 67 of material is sewn to the top 32 and bottom 33 of the right padded portion 12, thereby forming a loop through which the strap 36 is passed. This band 67 prevents the strap 36 from migrating off of the right padded portion 12. The adjuster buckle 63 is located on the strap 36 preferably just beyond the band 67 and off board from the right padded portion 12 when the right padded portion 12 is in the loosened condition thereof. From the adjuster buckle 63, the strap 36 continues to extend forward, to the front end 61 on which the buckle 37 is secured and to the other free end 68 of the strap 36.

Figure 4:
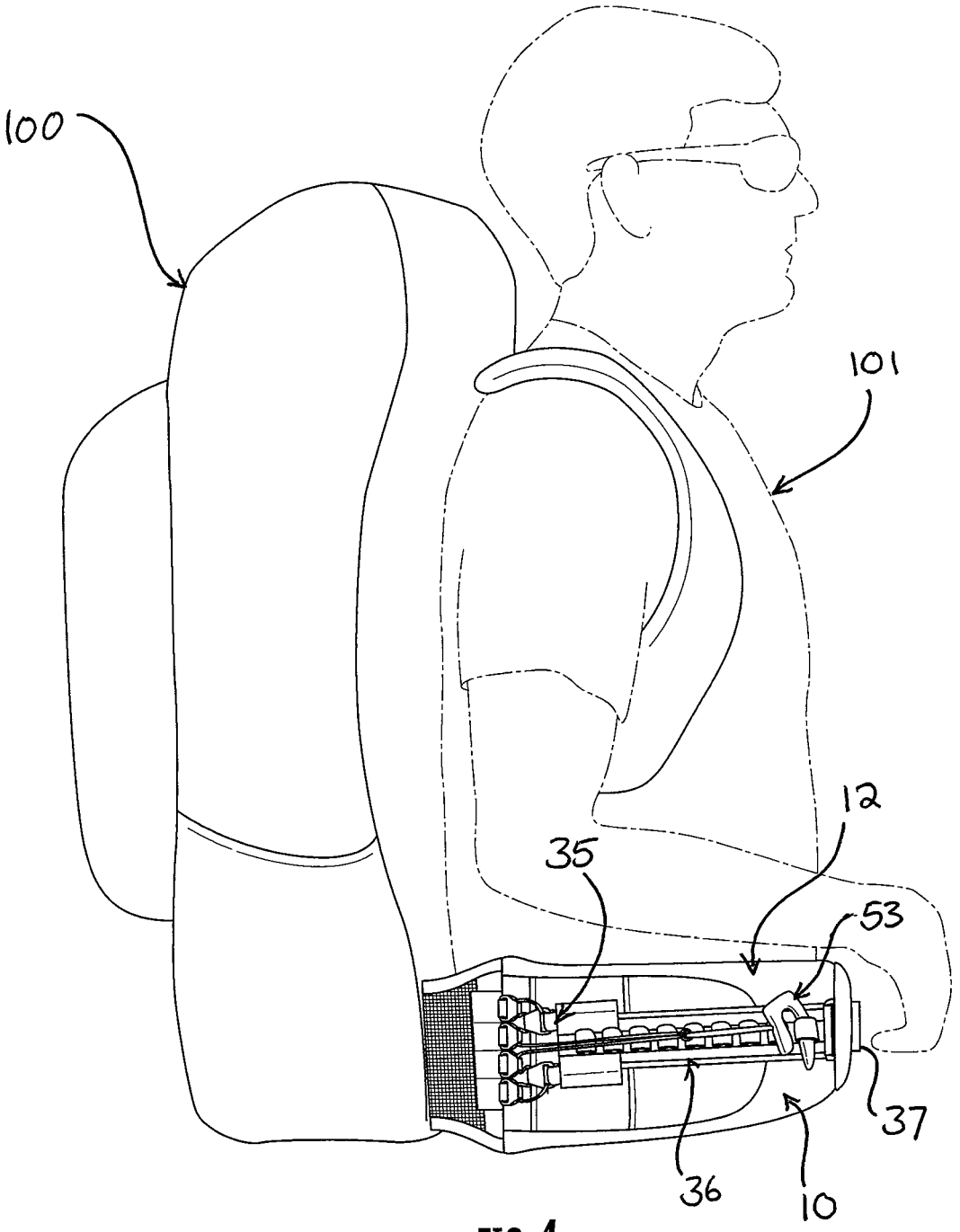
FIG. 4 illustrates the hip belt of FIG. 1 worn by a user in the tightened condition.

In operation, the hip belt 10 is used with a backpack 100 as illustrated in FIG. 4. Though shown with a traditional internal-frame backpack 100, the hip belt 10 is useful with external-frame backpacks, soft-frame backpacks, no-frame backpacks, child-carrying packs, and other packs apparatus for carrying loads. Indeed, the hip belt 10 can be used simply as a constriction belt, such as for weight-lifting or medical rehabilitation, where tightening and support about the waist is needed.

A user 101 puts on the backpack 100, slips the arm straps over his shoulders, and locates the right and left padded portions 12 and 13 around his hips. Preferably, the right and left padded portions 12 and 13 are both in the loosened conditions thereof. The user 101 takes up the straps 36 and 36' by hand and couples the buckles 37 and 37' into each other. The buckle 37 snappedly buckles into the complemental buckle 37' on the left padded portion 11. The user 101 then moves the hip belt 10 to the tightened condition shown in FIG. 3.

Returning to FIG. 2, the strap 36 has an effective length 70 to the buckle 37. This effective length 70 is measured between the rear end of 30 of the right padded portion 12 and the buckle 37. Once the buckles 37 and 37' are coupled to each other, adjusting the effective lengths 70 and 70' loosens or tightens the hip belt 10 on the user. This can be accomplished in either or both of two different manners. In a first manner, a gross adjustment is made. The user 101 takes up the free end 68 of the strap 36 by hand and pulls it away from the adjuster buckle 63. This causes the free end 68 to move out away from the adjuster buckle 63 and the front end 61 to move in toward the adjuster buckle 63, thereby shortening the effective length 70. Large adjustments are made in this fashion to quickly take up loose slack in the hip belt 10. Once the gross adjustment is made, the second manner of adjusting is undertaken. Similarly, the right padded portion 12 also has a pad length 71 between the rear and front ends 30 and 31. However, the pad length 71 remains the same despite adjustment of the strap 36, the buckle 37, or the pulley assembly 35.

In the second manner, a fine adjustment is made. After the gross adjustment has been made, the hip belt 10 is fairly well-tightened about the user 101. However, the fine adjustment allows the user 101 to carefully dial in exactly the desired amount of squeeze on the hip belt 10. The user grabs the catch 53 by the jaw 54 and pulls it along the molle 65 until the desired tightness about his waist is achieved. When he pulls the catch 53 forward, the minor pulley cords 51 and 52 move in a corresponding fashion and cause the yoke panel 45 to move in the opposite direction, toward the rear end 30 of the right padded portion 12. This is shown in FIG. 3, which is an illustration of the tightened condition of the right padded portion 12. In this condition, the effective length 70 has been reduced, as designated with the reference character 70*. Importantly, the pad length 71 of the right padded portion 12 between the rear end 30 and the front end 31 does not change; it does not expand, collapse, or alter when moving between the loosened and tightened conditions thereof.

The pulley assembly 35 reduces the effect of the pulling on the catch 53; when the catch 53 is moved forward a distance along the molle 65, the yoke panel 45 moves backward a lesser distance, so that the user 101 can affect small changes in tightness with large movements and without having to finely control his own movements. A different number of proximal and distal pulleys 40 and 41 would change the mechanical leverage and the reduction factor, and the hip belt 10 is not necessarily limited to the reduction factor of four proximal pulleys 40 and two distal pulleys 41 shown throughout the drawings.

Once the user 101 has found his desired tightness, the user 101 slips the jaw 55 into the proximate loop 66 on the molle 65. The user 101 fully seats the catch 53 on the loop 66; once fully seated, the major pull cord 50 pulls on the catch 53 opposite the jaw 55, and the catch 53 will not yield or inadvertently come loose. The user 101 can, at any time, slightly loosen or tighten the hip belt 10 by removing the catch 53 from the loop 66 and moving it forward or backward by just one or two loops.

Figure 5:
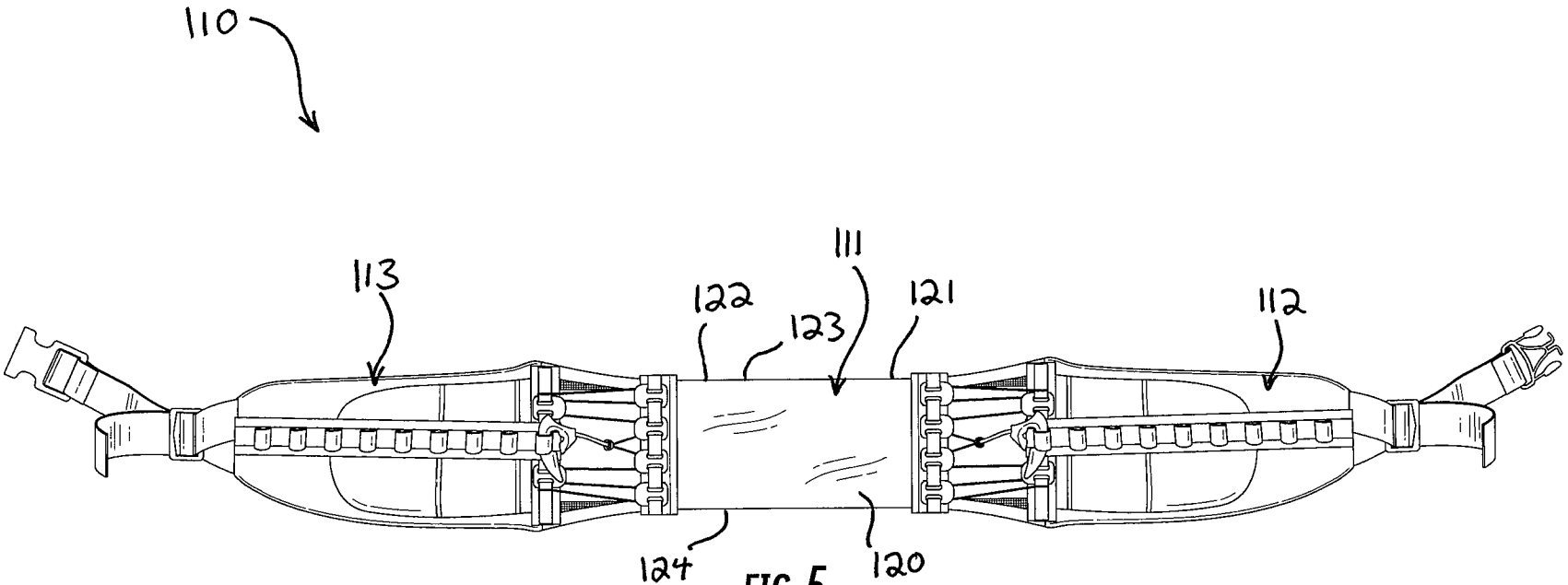
FIG. 5 is an elevation view of a modular hip belt with gross and fine adjustment, showing both left and right sides of the hip belt.

FIG. 5 illustrates a modular hip belt with boss gross and fine adjustment mechanisms (hereinafter, "hip belt 110". The hip belt 110 is similar in ways to the hip belt 10. The hip belt 110 includes a center panel 111 and first and second padded portions 112 and 113 connected to the center panel 111 and extending therefrom. For convenience and clarity, the first and second padded portions 112 and 113 will generally be referred to hereinafter as "right" and "left" padded portions 112 and 113 to correspond not only with their layout in the drawings but also with their intended orientation when the hip belt 110 is worn by a user.

The center panel 111 is a flexible yet inelastic support between the right and left padded portions 112 and 113. It provides a base supporting the padded portions 112 and 113 and allows the hip belt 110 to be integrated into a hiking backpack, child-carrying backpack, or other back support apparatus. The center panel 111 has an inner face, an outer face 120, opposed right and left sides 121 and 122, and a top 123 and bottom 124. The top 123 and bottom 124 are curved inwardly. The center panel 111 is constructed from a mesh panel.

The right and left padded portions 112 and 113 are affixed to the right and left sides 121 and 122 of the center panel 111, respectively. The right and left padded portions 112 and 113 are mirror identical, and so the following description of the right padded portion 112 applies equally to the left padded portion 113. As such, there will not be a detailed description of the left padded portion 113; one having ordinary skill in the art will readily understand how the description of the right padded portion 112 applies to the left padded portion 113. Further, the reference characters used to identify the various structural elements and features of the right padded portion 112 are also used to identify the same structural elements and features of the left padded portion 113. However, those of the left padded portion 113 are marked with a prime ("") symbol so as to distinguish them from those of the right padded portion 112.

Figure 6:
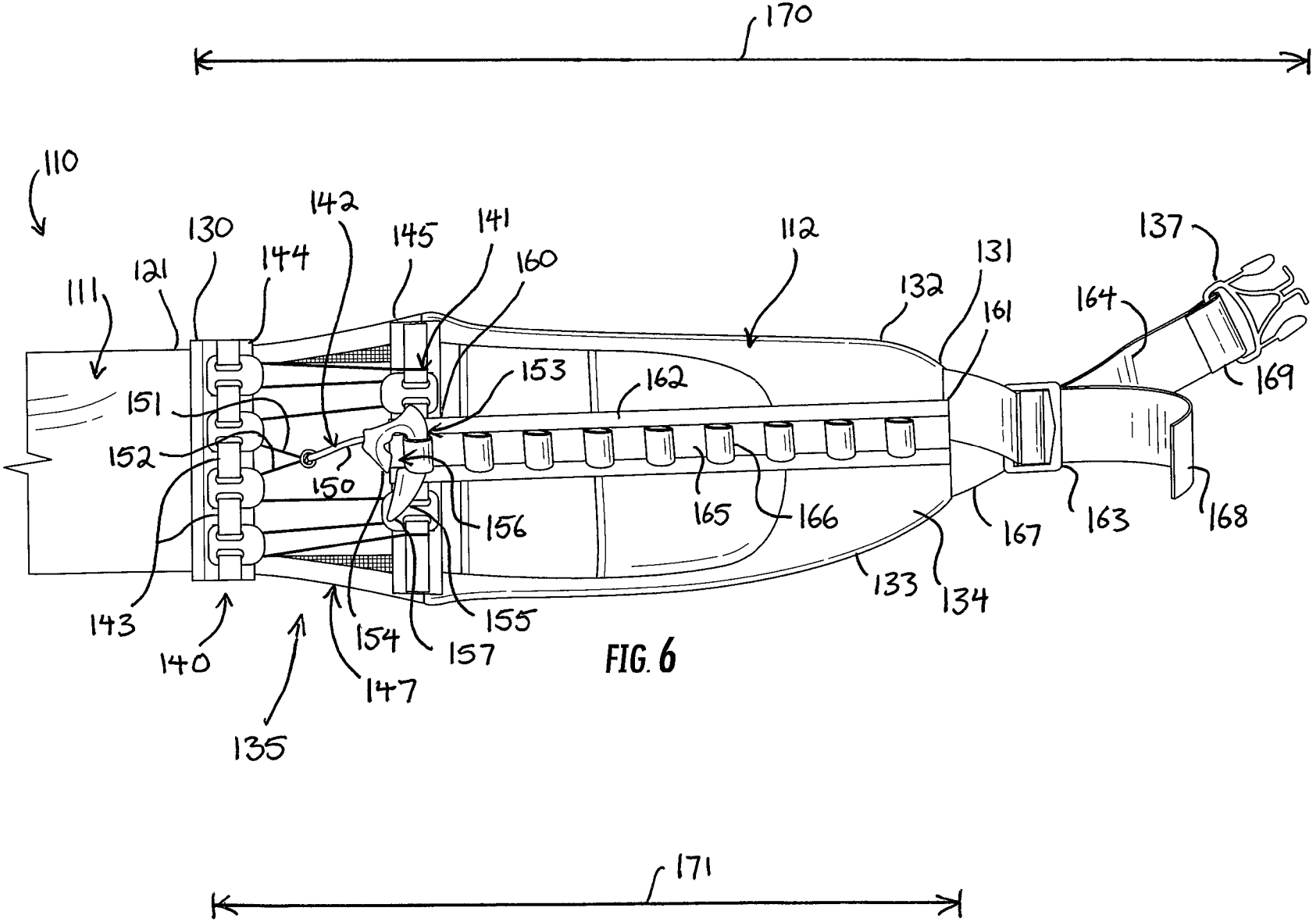
FIGS. 6 and 7 are elevation views of the right side of the hip belt of FIG. 5, showing loosened and tightened conditions, respectively.
Figure 7:
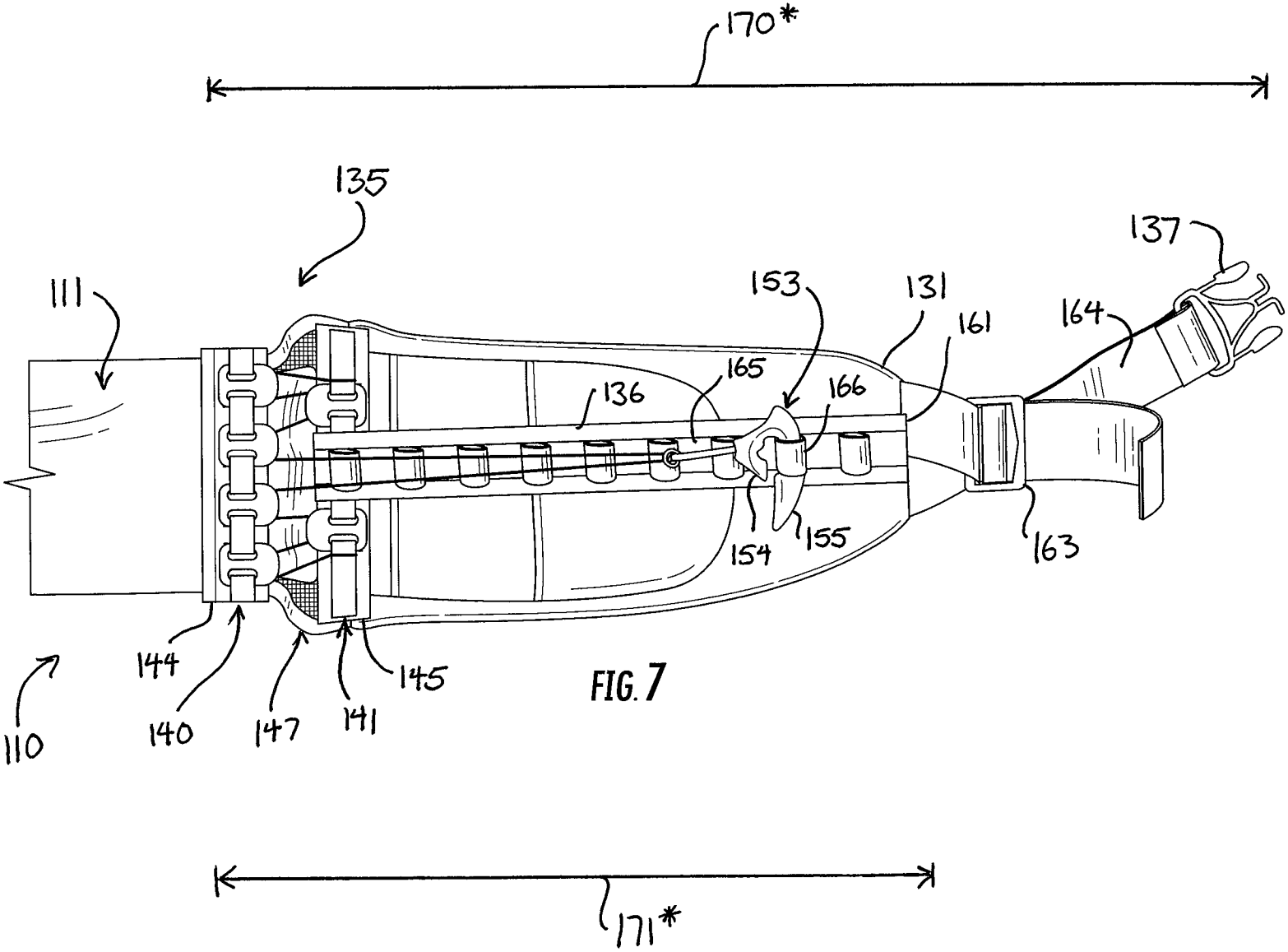

FIGS. 6 and 7 illustrate the right padded portion 112 in detail and show it in a first, loosened condition (FIG. 6) and a second, tightened condition (FIG. 7). The right padded portion 112 is a somewhat rigid and inflexible padded belt portion for placement over a user's hips when carrying a load. The right padded portion 112 is preferably constructed with a somewhat rigid plastic, metal, carbon fiber, or like insert, and a padded underlayer that is directed inward toward the user. The right padded portion 112 has a rear end 130 and an opposed front end 131. The rear end 130 is proximate to and fixed to the right side 121 of the center panel 111; when the hip belt 110 is worn, the rear end 130 is proximate the user's back and the front end 131 is proximate the user's front. The right padded portion 112 additionally has a top 132, a bottom 133, and an outer face 134 extending across the right padded portion 112 entirely between the top 132 and bottom 133 and between the rear and front ends 130 and 131. Across the outer face 134, the right padded portion 112 further carries an adjustable pulley assembly 135, a strap 136 which is affixed to the outer face 134 of the right padded portion 112, and a buckle 137.

The pulley assembly 135 includes a plurality of base or proximal pulleys 140, a different plurality of distal pulleys 141, and a cord 142 threaded between the pulleys 140 and 141. The proximal pulleys 140 are secured to the outer face 134 of the right padded portion 112 at the rear end 130 thereof, along a strip of webbing 144. The proximal pulleys 140 are secured to each other through short webbing jumpers 143. Each webbing jumper 143 is secured to two adjacent proximal pulleys 140 and is then sewn down to the strip of webbing 144. And each of the proximal pulleys 140 is arranged proximate the other in a stacked fashion, so that the webbing jumpers 143 are oriented vertically between the proximal pulleys 140. This holds the proximal pulleys 140 in place and maintains their lateral orientation toward the front end 131, as shown in FIGS. 6 and 7.

The distal pulleys 141 are fixed to a yoke strip 145. The yoke strip 145 is a piece of webbing or other inelastic material, thin and small in size, having opposed long sides. The distal pulleys 141 also have webbing jumpers 146. The webbing jumpers 146 are secured directly to the yoke strip 145 by strong and rugged reinforced stitching. The distal pulleys 141 are oriented laterally toward the proximal pulley 140 such that they are in a confronting arrangement. Between the proximal and distal pulleys 140 and 141 is a collapsible panel 147. The right padded portion 112 is somewhat rigid and inflexible between the yoke trip 145 and the front end 131, but the collapsible panel 147 is a loose panel of flexible, yet inelastic, fabric. The panel 147 can collapse and shrink in its lateral dimension when the pulley assembly 135 contracts.

Preferably, there are half as many distal pulleys 141 as proximal pulleys 140. In the embodiments shown throughout these drawings, there are two distal pulleys 141; an upper distal pulley 141 and a lower distal pulley 141. Likewise, there are two upper proximal pulleys 140 and two lower proximal pulleys 140. The upper distal pulley 141 corresponds to the two upper proximal pulleys 140, and the lower distal pulley 141 corresponds to the two lower proximal pulleys 140.

The winding of the cord 142 through the pulley assembly 135 reflects this correspondence. The cord 142 includes a major pull cord 150 and two minor pulley cords 151 and 152. The major pull cord 150 is connected to the two minor pulley cords 151 and 152, extending from them, proximate the proximal pulleys 140, to a catch 153. The minor pulley cord 151 wraps through the lower of the upper proximal pulleys 140, around through the upper distal pulley 141, back to the upper of the upper proximal pulleys 140, and then back to the upper distal pulley 141, where it is anchored. Similarly, the minor pulley cord 152 wraps through the upper of the lower proximal pulleys 140, around through the lower distal pulley 141, back to the lower of the lower proximal pulleys 140, and the back to the lower distal pulley 141, where it is anchored.

The catch 153 on the cord 142 has two projecting jaws 154 and 155, defining a space 156 therebetween. The cord 142 is attached to the jaw 154, which is very short and blunt. Apart from the jaw 154, the jaw 155 is longer, sharp, curves back toward the jaw 154, and is formed with an enlarged head 157. The jaw 154 is useful to be grasped by a user and the jaw 155 is useful for engaging and securing the catch 153 along the right padded portion 112.

As described above, the strap 136 is fixed to the outer face 120 of the right padded portion 112. The strap 136 has a rear end 160, proximate the yoke strip 145, and an opposed front end 161, proximate the front end 131 of the right padded portion 112. The strap 136 is preferably secured to the outer face 120 continuously along the outer face between its rear and front ends 160 and 161, but not necessarily so. The strap 136 has an outer face 162 directed away from the outer face 120. The outer face 162, between the yoke strip 145 and an adjuster buckle 163, carries a strip of molle 165. The strip of molle 165 is a strip of spaced-apart nylon loops 166. The loops 166 are arranged normal to the length of the right padded portion 112, so that their openings are directed vertically up and down.

At the front end 131 of the right padded portion 112, the front end of the strap 136 is fixed with stitching. A loop 167 of webbing projects forwardly from the front end 131, an adjuster buckle 163 is disposed on this loop 167. Another strap 164 is looped through the adjuster buckle 163; it has two opposed free ends 168 and 169. The free end 169 carries a buckle 137, while the other free end 168 is unadorned and available to be grasped.

Figure 8:
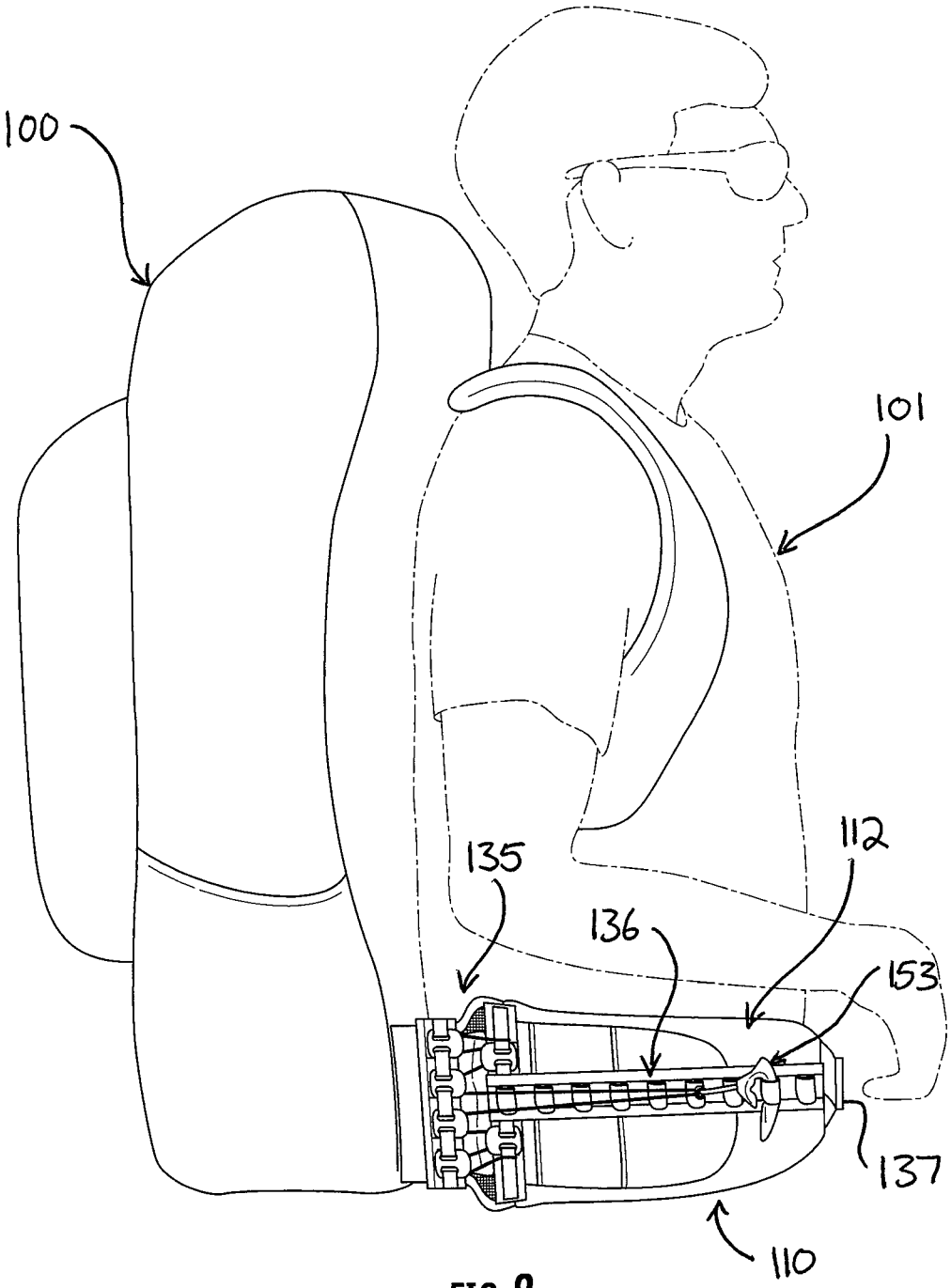
FIG. 8 illustrates the hip belt of FIG. 5 worn by a user in the tightened condition.

In operation, the hip belt 110 is used with a backpack 100 as illustrated in FIG. 8. Though shown with a traditional internal-frame backpack 100, the hip belt 110 is useful with external-frame backpacks, soft-frame backpacks, no-frame backpacks, child-carrying packs, and other packs apparatus for carrying loads. Indeed, the hip belt 110 can be used simply as a constriction belt, such as for weight-lifting or medical rehabilitation, where tightening and support about the waist is needed.

A user 101 puts on the backpack 100, slips the arm straps over his shoulders, and locates the right and left padded portions 112 and 113 around his hips. Preferably, the right and left padded portions 112 and 113 are both in the loosened conditions thereof. The user 101 takes up the straps 136 and 136' by hand and couples the buckles 137 and 137' into each other. The buckle 137 snappedly buckles into the complemental buckle 137' on the left padded portion 113. The user 101 then moves the hip belt 110 to the tightened condition shown in FIG. 5.

Returning to FIG. 6, the right padded portion 112 has an effective length 170 to the buckle 137. This effective length 170 is measured between the rear end of 130 of the right padded portion 112 and the buckle 137. Once the buckles 137 and 137' are coupled to each other, adjusting the effective lengths 170 and 170' will either loosen or tighten the hip belt 110 on the user. This can be accomplished in one of two, and preferably both, manners. In a first manner, a gross adjustment is made. The user 101 takes up the free end 168 of the strap 164 by hand and pulls it away from the adjuster buckle 163. This causes the free end 168 to move out away from the adjuster buckle 163 and the front end 161 to move in toward the adjuster buckle 163, thereby shortening the effective length 170 of the right padded portion 112. Large adjustments are made in this fashion to quickly take up loose slack in the hip belt 110. Once the gross adjustment is made, the second manner of adjusting is undertaken. Similarly, the right padded portion 112 also has a pad length 171 between the rear and front ends 130 and 131. While the pad length 171 remains the same despite adjustment of the strap 164 or the buckle 137, it does change when the pulley assembly 135 is loosened or tightened.

In the second manner, a fine adjustment is made. After the gross adjustment has been made, the hip belt 110 is fairly well-tightened about the user 101. However, the fine adjustment allows the user 101 to carefully dial in exactly the desired amount of squeeze on the hip belt 110. The user grabs the catch 153 by the jaw 154 and pulls it along the molle 165 until the desired tightness about his waist is achieved. When he pulls the catch 153 forward, the minor pulley cords 151 and 152 move in a corresponding fashion and cause the yoke strip 145 to move in the opposite direction, toward the rear end 130 of the right padded portion 112. This causes the collapsible panel 147 between the proximal and distal pulleys 140 and 141 to collapse. This is shown in FIG. 7, which is an illustration of the tightened condition of the right padded portion 112. In this condition, the effective length 170 has been reduced, as designated with the reference character 170*. Further, the pad length 171 has also been reduced, as designated with the reference character 171*.

The pulley assembly 135 reduces the effect of the pulling on the catch 153; when the catch 153 is moved forward a distance along the molle 165, the yoke strip 145 moves backward a lesser distance (and the collapsible portion collapses by a similar lesser distance), so that the user 101 can affect small changes in tightness with large movements and without having to finely control his own movements. A different number of proximal and distal pulleys 140 and 141 would change the mechanical leverage and the reduction factor, and the hip belt 110 is not necessarily limited to the reduction factor of four proximal pulleys 140 and two distal pulleys 141 shown throughout the drawings.

Once the user 101 has found his desired tightness, the user 101 slips the jaw 155 into the proximate loop 166 on the molle 165. The user 101 fully seats the catch 153 on the loop 166; once fully seated, the major pull cord 150 pulls on the catch 153 opposite the jaw 155, and the catch 153 will not yield or inadvertently come loose. The user 101 can, at any time, slightly loosen or tighten the hip belt 110 by removing the catch 153 from the loop 166 and moving it forward or backward by just one or two loops.

Figure 9:
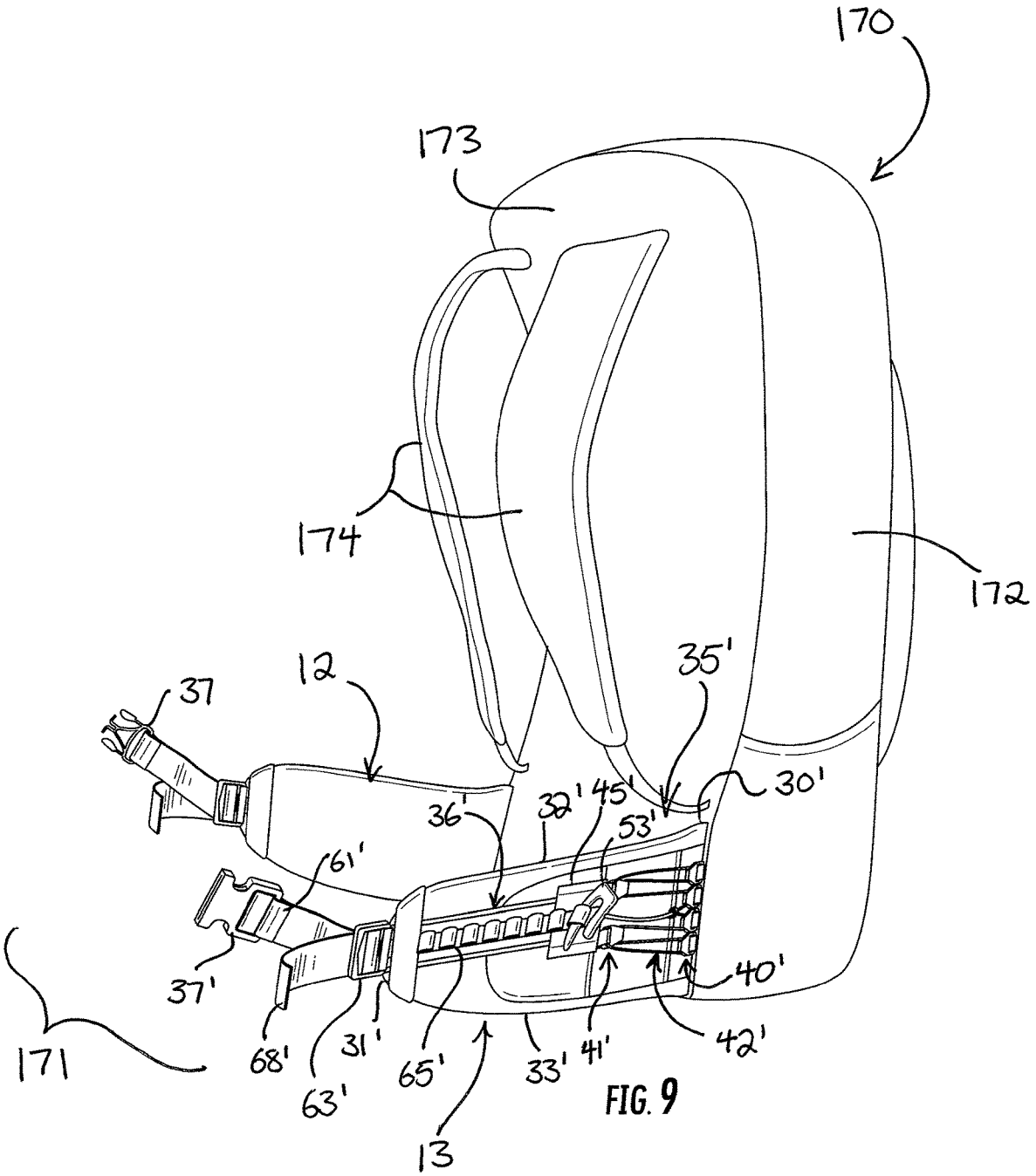
FIG. 9 is a perspective view of a backpack with an integrated hip belt.

FIG. 9 illustrates a backpack 170 with an integrated hip belt 171. The backpack 170 has a body 172, a back panel 173, two shoulder straps 174 extending from the back panel 173, and the hip belt 171. The body 172, back panel 173, and shoulder straps 174 are exemplary of such conventional parts of a backpack, specifically, an internal-frame hiking backpack, and one having ordinary skill in the art should understand that modifications and different bodies 172, back panels 173, and shoulder straps 174 may be suitable. However, the hip belt 171 is uniquely used with the backpack 170 and thus renders the backpack 170 itself.

The hip belt 171 shown in FIG. 9 is similar to the hip belt 10. Indeed, the hip belt 171 is nearly identical to the hip belt 10, but that it is attached to the back panel 173 without a center panel 11. As such, there will not be a detailed description of the structural elements and features of the hip belt 171 that are the same as those of the hip belt 10. Instead, the reference characters used to identify the various structural elements and features of the hip belt 10 (and of the right and left padded portions 12 and 13) are used to identify the same structural elements and features of the hip belt 170. Moreover, the reference characters used with the left padded portion 13 carry the same prime symbol as those of the hip belt 10. Some of the elements and features of the hip belt 171 are listed below and some are shown on FIG. 9; others are not for the sake of brevity and clarity, and because one having ordinary skill in the art will understand their structure, location, and arrangement from the description above.

The hip belt 171 thus has a first or right padded portion 12 and a second or left padded portion 13. The left padded portion 13 is more clearly shown in FIG. 9. It includes a rear end 30', a front end 31', a top 32', a bottom 33', a pulley assembly 35', a strap 36', a buckle 37', proximal pulleys 40', distal pulleys 41', a cord 42', a yoke panel 45', a catch 53', a front end 61', an adjuster buckle 63', molle 65', and a free end 68'. Again, not all structural elements and features of the right padded portion 12 of the hip belt 171 are listed or shown, because they are described and shown with respect to the hip belt 10.

The rear end 30' of the right padded portion 12 is proximate to and fixed, such as by stitching, sonic welding, or other method, to a left side of the back panel 173. This places the proximal pulleys 40' close to the back panel 173, but still leaves them unencumbered by the back panel 173. When the back pack 170 is worn and the hip belt 171 is tightened, the distal pulleys 40', and indeed, the whole pulley assembly 35', are away from the back panel 173 and the body 172 of the bag 170 and as such are not infringed, rubber, or otherwise interfered with. This allows the user to pull on the catch 53' and adjust it as necessary without resistance from the bag 170. When the user adjusts the catch 53', it tightened or loosened, and the effective length 70' is shortened or lengthened. The back panel 173 is flexible yet inelastic, like the center panel 11 of the hip belt 10, and so when the user adjusts the effective length, he or she makes the hip belt 171 snugger or looser.

Although FIG. 9 shows a hip belt 171 which borrows the structural elements and features of the hip belt 10, one having ordinary skill in the art should readily appreciate that an alternate hip belt—directly attached to the back panel 173—could borrow the structural elements and features of the hip belt 110.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A hip belt comprising:
- a center panel, and first and second padded portions connected to the center panel and extending therefrom;
- each of the first and second padded portions comprising:
  - a rear end proximate to the center panel, an opposed front end, and a face extending therebetween;
  - a pulley assembly carried on the respective first or second padded portion, and a catch coupled to the pulley assembly for secured engagement along the face;
  - a strap secured to the pulley assembly over the respective first or second padded portion, wherein the strap carries molle loops for receiving and securely engaging the catch; and
  - a buckle carried at a front end of the respective first of second padded portion.

2. The hip belt of claim 1, wherein the strap is secured to the pulley assembly for sliding movement along the face of the respective first or second padded potion.

3. The hip belt of claim 1, wherein the strap is fixed to the face of the respective first or second padded portion.

4. The hip belt of claim 1, wherein each of the first and second padded portions further comprises:
- an effective length between the buckle and the rear end;
- the buckle is adjustable along the strap to grossly adjust the effective length; and
- the pulley assembly is adjustable to finely adjust the effective length.

5. The hip belt of claim 4, wherein each of the first and second padded portions further comprises:
- a pad length between the front and rear ends of the respective first or second padded portion;
- a loosened condition and a tightened condition of the respective first or second padded portion; and during movement between the loosened and tightened condition, the effective length changes and the pad length remains unchanged.

6. The hip belt of claim 5, wherein, for each of the first and second padded portions, during movement from the loosened condition to the tightened condition, the strap moves toward the rear end of the respective first or second padded portions.

7. The hip belt of claim 1, wherein each of the first and second padded portions further comprises a transverse band at the front end of the respective first or second padded portion, the strap extending between the band and the respective first or second padded portion.

8. The hip belt of claim 1, wherein each of the first and second padded portions further comprises:

the pulley assembly comprises proximal pulleys located at the rear end of the respective first or second padded portion, distal pulleys located between the front and rear ends, and a cord wound around the proximal and distal pulleys; and a catch coupled to the cord, wherein movement of the catch toward the front end tightens the pulley assembly and movement of the catch away from the front end loosens the pulley assembly.

9. A hip belt comprising:

a center panel, and first and second padded portions connected to the center panel and extending therefrom;

each of the first and second padded portions comprising:

a rear end proximate to the center panel, an opposed front end, and a face extending therebetween;

a pulley assembly carried on the respective first or second padded portion, wherein the pulley assembly comprises proximal pulleys located at the rear end of the respective first or second padded portion, distal pulleys located between the front and rear ends, and a cord wound around the proximal and distal pulleys;

a catch coupled to the cord, wherein movement of the catch toward the front end tightens the pulley assembly and movement of the catch away from the front end loosens the pulley assembly a strap secured to the pulley assembly over the respective first or second padded portion; and a buckle carried at the front end of the respective first or second padded portion.

10. The hip belt of claim 9, wherein the strap is secured to the pulley assembly for sliding movement along the face of the respective first or second padded portion.

11. The hip belt of claim 9, wherein the strap is fixed to the face of the respective first or second padded portion.

12. The hip belt of claim 9, wherein each of the first and second padded portions further comprises:

an effective length between the buckle and the rear end;

the buckle is adjustable with respect to the front end to grossly adjust the effective length; and the pulley assembly is adjustable to finely adjust the effective length.

13. The hip belt of claim 12, wherein each of the first and second padded portions further comprises:

a pad length between the front and rear ends of the respective first or second padded portion;

a loosened condition and a tightened condition of the respective first or second padded portion; and movement between the loosened and tightened condition changes both the effective length and the pad length.

14. The hip belt of claim 13, wherein, during movement from the loosened condition to the tightened condition, the strap moves toward the rear end of the respective first or second padded portions.

15. The hip belt of claim 9, wherein the strap of each of the first and second padded portions carries molle loops for receiving and securely engaging the catch.

16. A hip belt comprising:

a center panel, and first and second padded portions connected to the center panel and extending therefrom;

each of the first and second padded portions comprising:

a rear end proximate to the center panel, an opposed front end, and a face extending therebetween;

a pulley assembly carried on the respective first or second padded portion, wherein the pulley assembly comprises proximal pulleys located at the rear end of the respective first or second padded portion, distal pulleys located between the front and rear ends, and a cord wound therebetween;

a collapsible panel between the proximal and distal pulleys which collapses when the pulley assembly contracts; and a buckle carried at a front end of the respective first of second padded portion.

17. The hip belt of claim 16, wherein each of the first and second padded portions further comprises:

a pad length between the front and rear ends, and an effective length between the buckle and the rear end;

the buckle is adjustable to grossly adjust the effective length; and the pulley assembly is adjustable to finely adjust the effective length.

18. The hip belt of claim 16, wherein each of the first and second padded portions further comprises:

a catch coupled to the cord, wherein movement of the catch toward the front end tightens the pulley assembly and movement of the catch away from the front end loosens the pulley assembly.

19. The hip belt of claim 16, wherein when the pulley assembly is adjusted, the effective length changes and the pad length remains unchanged.

20. The hip belt of claim 16, wherein when the pulley assembly is adjusted, both the effective length and the pad length change.

* * * * *